United States Patent [19]

Salomon

[11] 4,140,331

[45] Feb. 20, 1979

[54] SPORTS EQUIPMENT

[75] Inventor: Georges P. J. Salomon, Annecy, France

[73] Assignee: S.A. des Etablissements Francois Salomon & Fils, Annecy, France

[21] Appl. No.: 766,494

[22] Filed: Feb. 7, 1977

[30] Foreign Application Priority Data

Feb. 10, 1976 [FR] France ..... 76 03564
Jun. 29, 1976 [FR] France ..... 76 19689

[51] Int. Cl.[2] ..... A63C 9/08
[52] U.S. Cl. ..... 280/612
[58] Field of Search ..... 280/612, 611, 627, 616, 280/623

[56] References Cited

U.S. PATENT DOCUMENTS

| | | | |
|---|---|---|---|
| 3,367,672 | 2/1968 | Tonozzi et al. | 280/612 |
| 3,819,199 | 6/1974 | Smolka et al. | 280/612 |
| 3,892,980 | 7/1975 | Anderson | 280/612 X |
| 3,907,316 | 9/1975 | Marker et al. | 280/612 |

*Primary Examiner*—Joseph F. Peters, Jr.
*Assistant Examiner*—Milton L. Smith
*Attorney, Agent, or Firm*—Haseltine, Lake & Waters

[57] ABSTRACT

A safety ski binding whereby a ski is secured detachably to a ski boot including an electrical or electronic device connected to a supply of electricity. A switch is located between the device and supply and includes a moveable part which is actuated automatically when the ski is fitted to the boot or removed from the boot. The switch may either be a normally open switch or a normally closed switch.

22 Claims, 15 Drawing Figures

5a
5b
47
48
2
3
46
4
1

20
23
25
24
4
2
3
1
21
22

24
25
24
3
4
2

SPORTS EQUIPMENT

BACKGROUND OF THE INVENTION

The present invention relates to improvements applied to sports equipment which can be worn on the feet, in particular to winter sports equipment such as skis, snow shoes, studs etc., comprising an electrical or electronic device which has to be connected to a source of current (or disconnected therefrom) when the equipment is removed from the foot and disconnected (or connected) when the equipment is placed on the foot.

In fact, it may be necessary that certain electrical or electronic devices mounted on sports equipment worn on the feet are disconnected from a source of current when in practical use, for example during skiing and on the contrary connected to the source of current when these articles are not used (for example not during skiing). This may be the case for electronic devices in particular, comprising an emitter which makes it possible to find the articles in question when they are buried under the snow and possibly to find their user, in particular at the time of avalanches, or even electronic anti-theft devices actuated solely when the skier is no longer using his skis.

On the contrary, other electrical or electronic devices have to be connected to a source of current when the sports equipment is placed on the feet. This is particularly necessary in the case of electrical or electronic circuits controlling the release of a safety binding for skis. Generally, these circuits comprise detection, measuring, calculation, comparison and release members. These circuits require an electrical supply and the closure of the circuit generally takes place by a switch which the skier actuates manually. However, the skier may forget to close the electrical circuit and he will nevertheless be able to ski. This is a very considerable drawback, since he will thus be skiing without any safeguard if the bindings lock even in the absence of electrical current. If they do not lock, there is then a danger of the skier falling due to inopportune "opening" at the time of his first maneuvre.

The skier may also think to close the circuit for skiing but forget to open the latter when he removes his skis: in this case, the supply will therefore continue to take place and the batteries will quickly run down.

SUMMARY OF THE INVENTION

An object of the invention is to provide a particularly reliable device, not allowing a permanent and useless discharge of the electrical supply.

To this end, this sports equipment which can be worn on the feet, such as a ski, snow shoe, studs etc., comprising at least one device for retaining boots on said article, at least one electrical or electronic device connected to an electrical supply and a switch device located between the electrical or electronic device and the supply is characterized in that the switch device comprises a movable part and is a connecting device which is normally open and/or a disconnecting device which is normally closed and in that the movable part is actuated automatically at the time of placing the articles on the feet and at the time of voluntary or safe removal of the latter.

The advantages offered for the invention are thus that no inopportune use of the supply is possible, since it is linked solely with the presence or absence of the boot on the sports equipment.

BRIEF DESCRIPTION OF THE DRAWINGS

Various embodiments of the invention will be described hereafter, as non-limiting examples, with reference to the accompanying drawings in which:

FIG. 1 is a diagrammatic elevational view of one embodiment in which the switch device is actuated directly by the boot.

FIG. 2 is an elevational view of a variation of FIG. 1.

FIG. 3 is a similar view showing a variation actuated by direct action of the skier's foot during fitting of his boot/binding.

FIG. 4 is a similar view showing an embodiment where the boot acts indirectly on the switch device through the intermediary of a part put in position for this purpose.

FIG. 5 is a similar view showing one embodiment where the switch device is controlled by the movement of the binding arrangement at the time of fitting on the foot.

FIG. 6 is a similar view showing an embodiment where the switch device is controlled by a movable part of the binding.

FIG. 7 is a similar view of another embodiment where the switch device is controlled by a movable part of the binding.

FIG. 8 is a similar view showing a variation where the boot itself closes the circuit.

FIG. 9 is a similar view showing an embodiment where the presence of the boot controls the switch device.

FIG. 10 is a similar view showing an embodiment where the weight of the skier on the ski controls the switch device.

DETAILED DESCRIPTION

Figure 1:
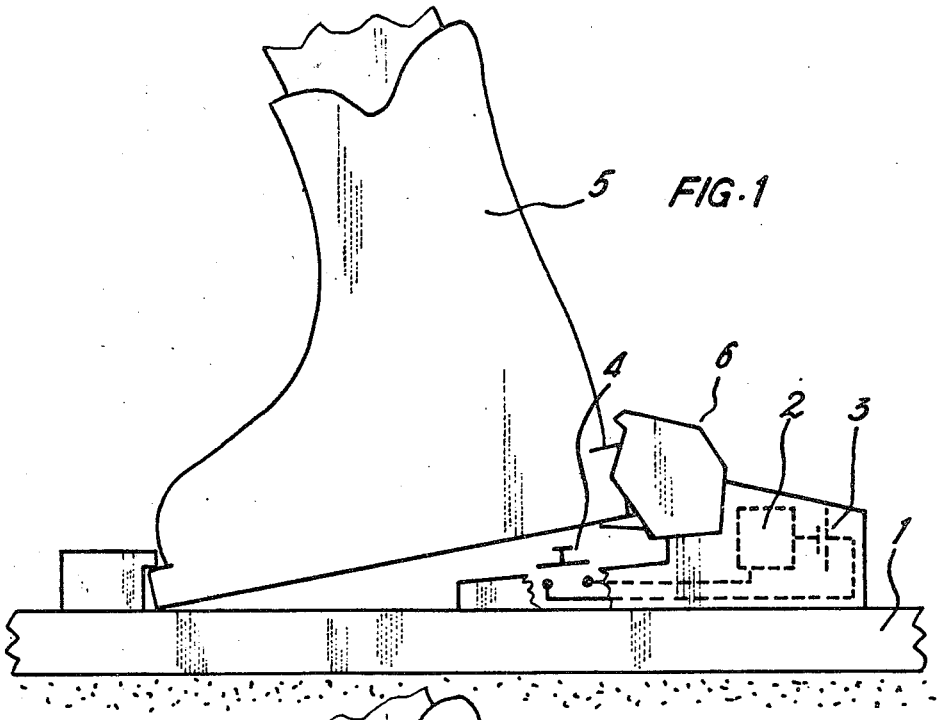
FIGS. 1 to 10 show diagrammatically embodiments in which one uses a switch device of the start/stop type, namely a switch which is normally open and which is closed for skiing.

All the embodiments and variations illustrated in FIGS. 1 to 14 show a safety binding, whether or not multi-directional, mounted on a ski 1 and which comprises an electrical or electronic device 2 symbolized by a square. This electronic or electrical device 2 may control the release of the binding and comprise a circuit for detection, calculation and controlling the release, as well as all the other accompanying circuits necessary for operation. It may also be a transmitter facilitating the remote detection of the presence of a ski buried in the snow or even an electronic anti-theft device.

This device requires an electrical supply (cell or battery) represented by reference numeral 3. A switch device 4 is connected to the device 2 and to the supply 3, this switch device being constituted by any means capable of connecting or disconnecting the electrical or electronic device to or from a source of current.

In FIGS. 1 to 10, the electrical or electronic device 2 is a circuit controlling the release of the binding: it is associated with a switch device 4 which is a switch normally open and only closed in the case where the ski is fitted on the skier's foot, this switch being constituted, for example, by a monostable push-button.

On the other hand, in the embodiments illustrated in FIGS. 11 to 14, where the device 2 is a transmitter or anti-theft device, for example, which is intended to operate when the ski is removed, the switch device is of the type constituted, for example, by a monostable push-button which is normally closed and which is opened when the ski is fitted.

FIG. 1 shows a first embodiment in which the boot 5 directly actuates the switch device 4, during fitting of the binding 6. The circuit 2 is thus automatically closed during fitting and on the other hand, at the time of removal, this circuit is automatically opened. In this case, the switch 4 is mounted on the base of the binding at a point where the sole of the boot rests and it is constituted by a contact actuated mechanically. The switch device is a monostable push-button which is normally open and which is closed when the boot is present on the sports equipment.

Figure 2:
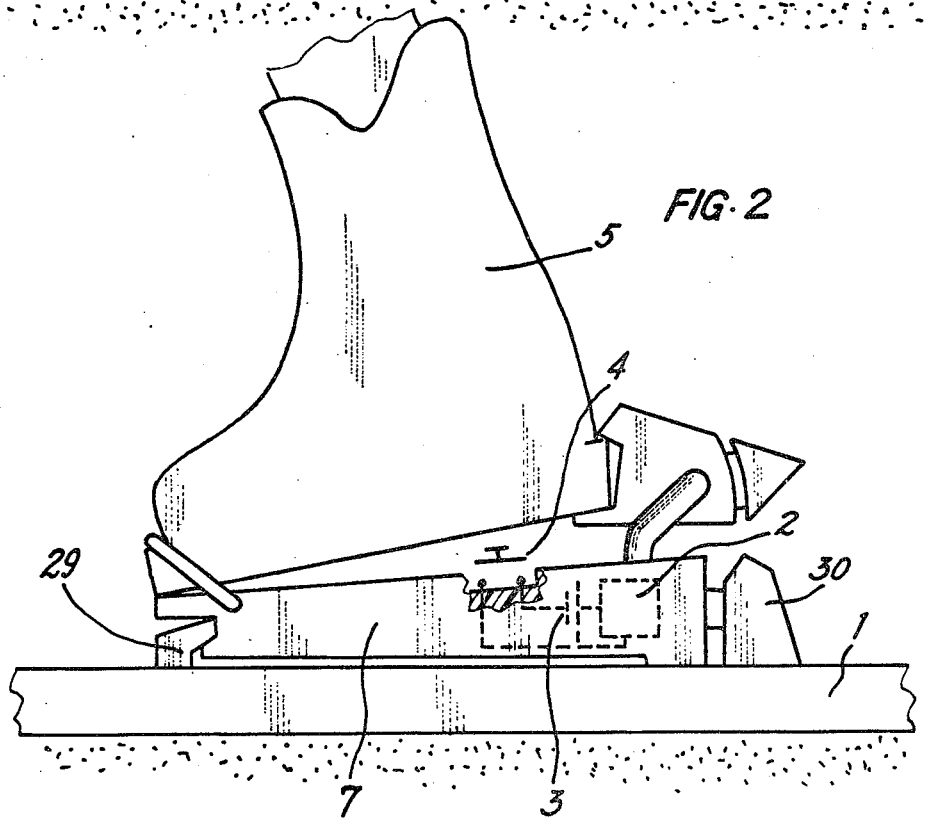

FIG. 2 shows a variation in which the boot 5 is mounted on a release plate 7 in which are housed the circuit 2 and the electrical supply 3. The boot remains fixed on the plate 7, the release taking place between the latter and a front and rear member 29 and 30 respectively, located on the ski 1. In this case, the switch device 4 is mounted on the upper side of the plate 7 in order to be able to be actuated by the sole of the boot.

Figure 3:
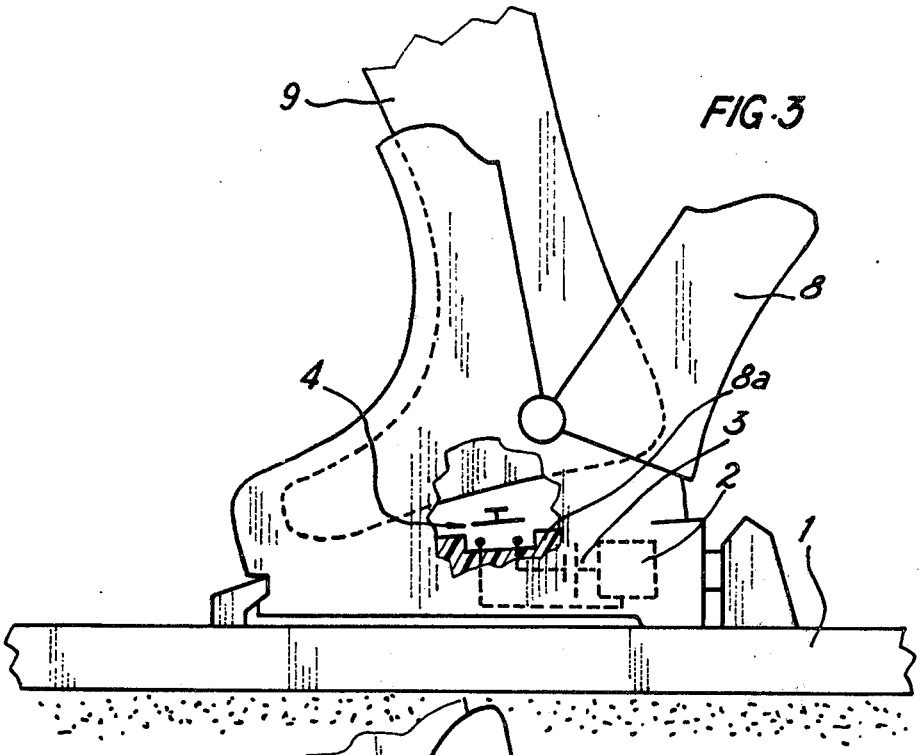

FIG. 3 shows another variation in which it is the introduction of the foot 9 into a boot/binding 8 which causes the actuation of the switch device 4. To this end, this device 4 is housed in the upper part of the sole **8*a* of the boot/binding 8, which contains the circuit 2 and electrical supply 3** in its lower part.

Figure 4:
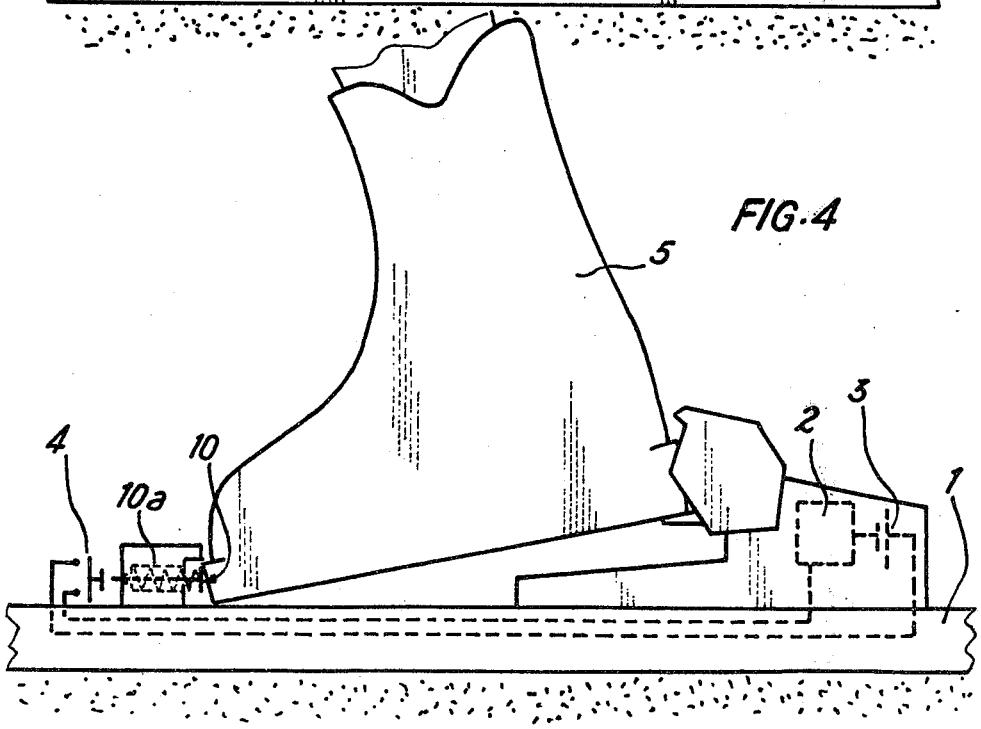

FIG. 4 shows an embodiment in which the boot 5 actuates the switch device 4 indirectly. To this end, a feeler 10 detects the presence of the boot 5 on the ski. This feeler 10 which is biased by a spring **10*a*, may be mounted at any point on the binding, in particular on a front abutment and is pushed back by the spring 10*a* in contact with the boot. At the time of fitting the ski, the feeler 10 is pushed back by the boot and acts on the switch device 4 for closing the circuit 2. When the ski is removed, the feeler 10 releases the device 4 and opens the circuit 2. The feeler 10** may either be mounted to slide or pivot and in this latter case, it could also possibly serve as a ski brake.

Figure 5:
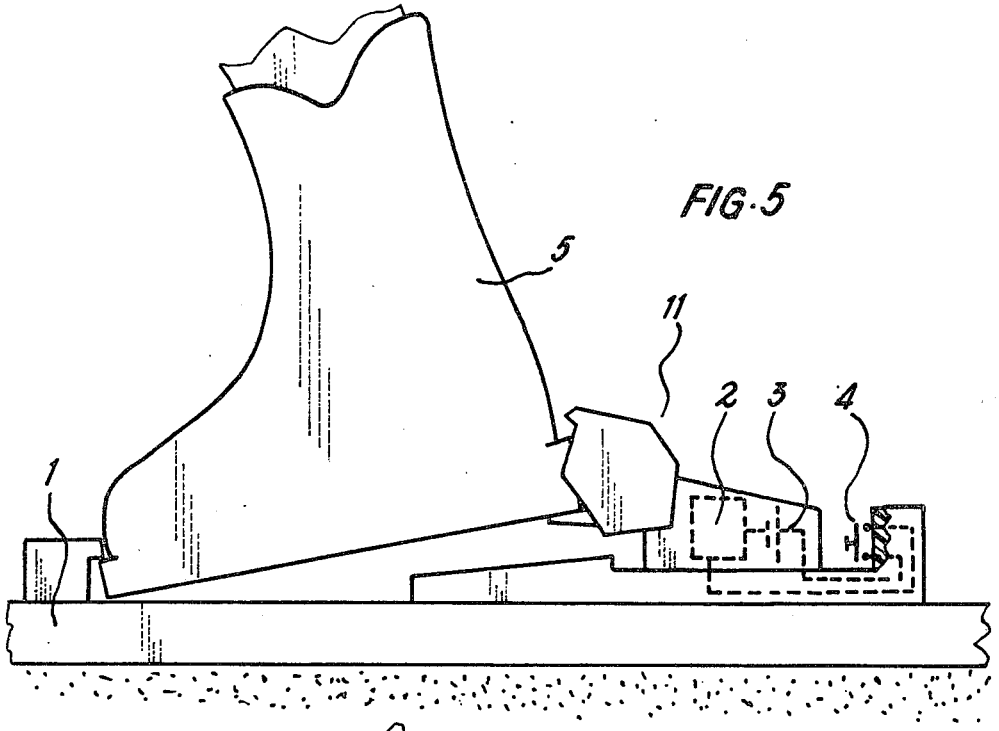

FIG. 5 shows another embodiment in which it is the binding 11 which, during fitting or removal of the ski, actuates or releases the switch device 4. In known manner, the bindings (in particular for the rear of the boot) move longitudinally rearwards (or forwards) at the time of fitting or removing the ski, against the action of springs. This movement will therefore be used for actuating the device 4, at the end of the rearwards or forwards travel. On removing the ski, the binding 11 once more moves forwards and releases the device 4 thus automatically opening the circuit 2. According to the invention, it is possible to use not only the translatory movement of the binding at the time of fitting the ski, but also any other movement, in particular, rotation.

Figure 6:
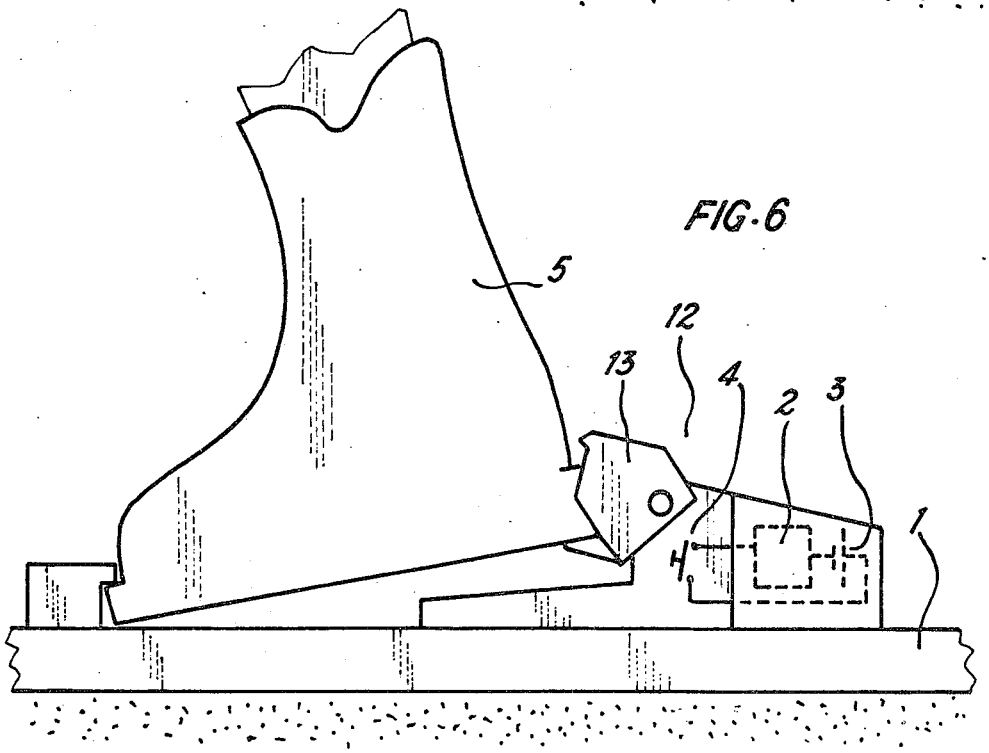

In the embodiment illustrated in FIG. 6, the movement of one of the moving parts of the binding 12 is used for actuating the switch device 4, at the time of fitting the ski. At the time of removing the latter, this part releases said device. As illustrated in FIG. 6, it is a pivoting jaw 13 of the binding 12 which, at the time of fitting the ski, actuates the device 4, which is independent of the jaw 13. In this embodiment, the binding 12 is provided with means such that the jaw 13 is raised automatically when there is no boot on the ski.

With an arrangement of this type, it is possible to have closure of the contacts only if the boot is present on the ski. Improper use of the current therefore cannot occur. Any other moving part of the binding could also be used for controlling the switch device.

Figure 7:
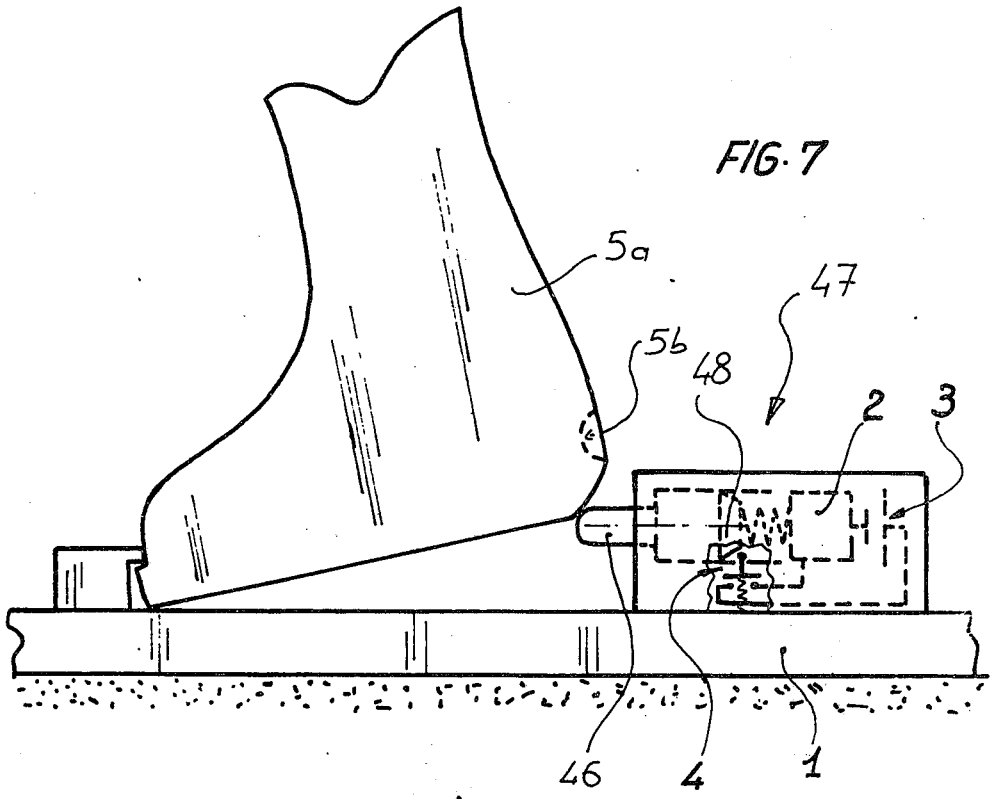

In the embodiment illustrated in FIG. 7, it is thus a moving part of the binding which actuates the switch device 4. In this case, one uses a boot/binding **5*a* having a locking housing 5*b* at its rear part. A piston 46 occupies the housing 5*b* during skiing. This piston 46 is mounted to slide in the body of the binding 47. The release circuit 2 ensures the withdrawal of this piston for release of the boot. The switch device 4 is mounted in the body of the binding 47 and is normally open (as shown in the drawing). When fitting the ski, the piston 46 is withdrawn and the rear part 48 of the piston acts on the device 4 in order to close the circuit and therefore ensure a supply to the circuit 2. When the binding is not fitted, the piston is in the advanced position and the switch device 4 is released and the circuit 2** is open.

Figure 8:
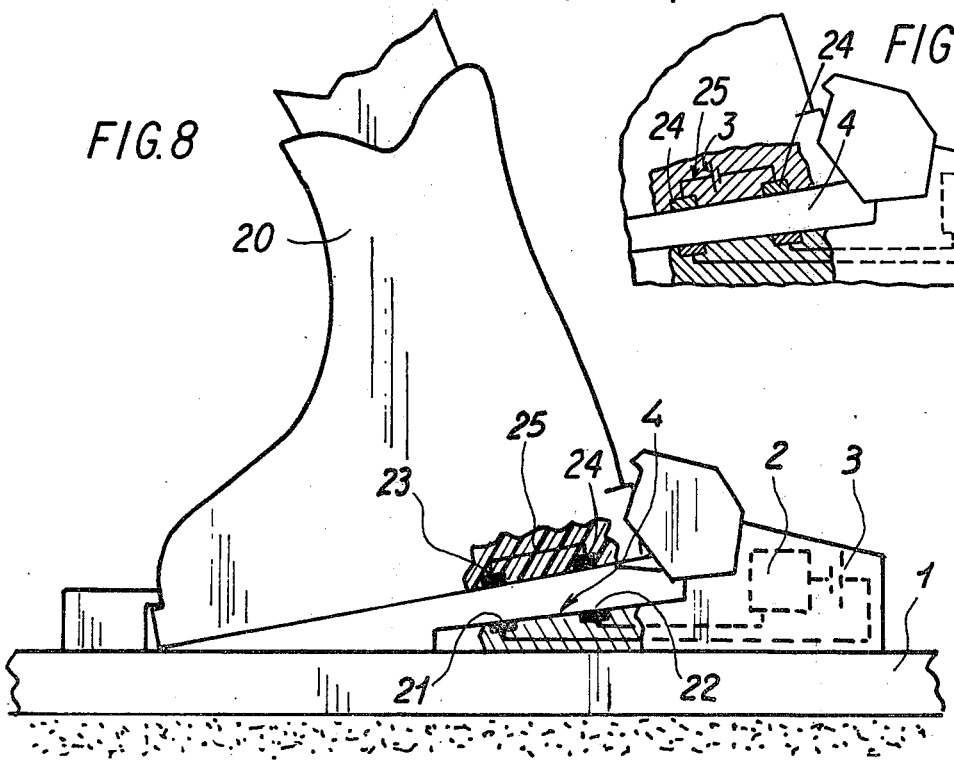
Figure 8A:
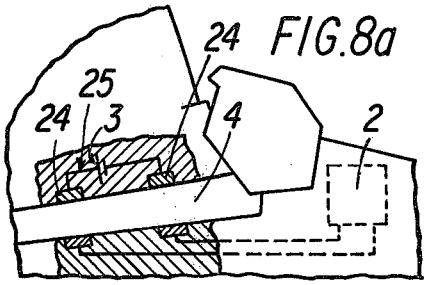
FIG. 8*a* is similar to FIG. 8 but shows a variation thereof.

In the embodiment illustrated in FIG. 8, the boot 20 supports part of the switch device 4, the other part being provided on the ski 1 or binding. To this end, the device 4 comprises, on the binding or ski, two fixed contact studs 21 and 22 connected respectively to the supply 3 and to the circuit 2 and, in the lower side of the sole of the boot 20, two other movable contact studs 23 and 24, intended to co-operate with the studs 21 and 22. The two contact studs 24 and 23 are connected by a wire 25 embedded in the sole or housed in the surface of the latter. According to the variation as shown in FIG. **8*a*, the supply 3 may be housed in the boot on the wire 25 between the two contact studs 23 and 24**.

According to another variation, it is also possible to use a metal plate connected to the boot to act as a connector bar, this metal plate possibly supporting release ramps.

Figure 9:
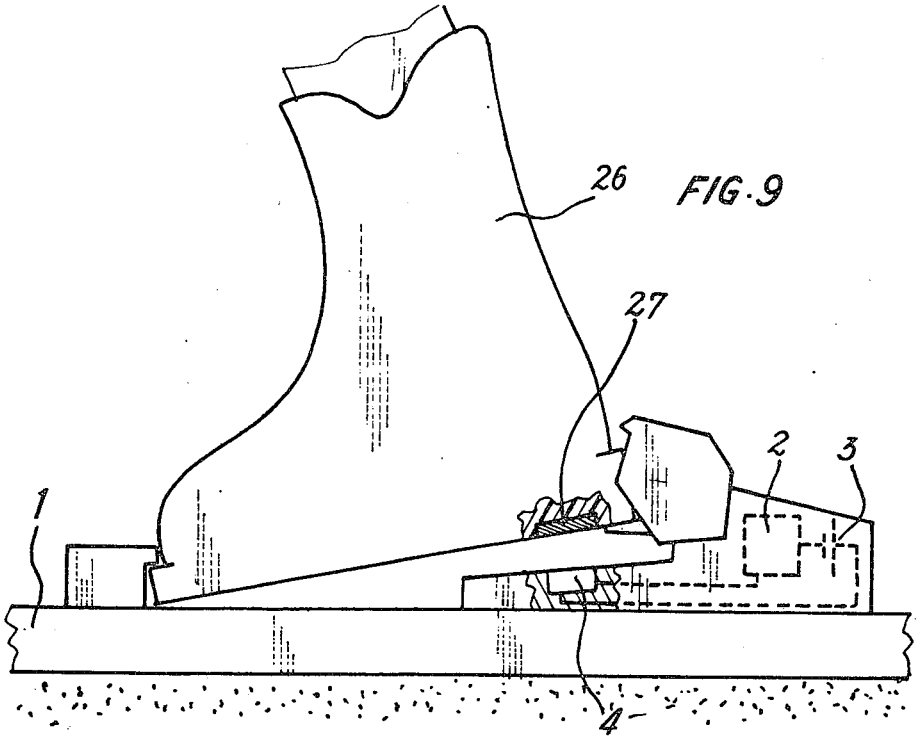

In the embodiment illustrated in FIG. 9, it is the presence or absence of the boot which causes the actuation or release of the switch device 4. To this end, in the embodiment illustrated, the switch device 4 is preferably a magnetic switch actuated by a magnet 27 carried by the boot 26. When the boot is secured in position, the magnet 27 acts on the device 4 and the circuit is closed. When removing the ski, opening of the circuit takes place automatically owing to opening of the magnetic switch 4. The magnet 27 could be replaced by a simple ferro-magnetic plate carried by the boot, the magnet 27 being advantageously placed around the device 4. It would be the variation of the magnetic flux between the fitted and removed positions which would control the switch device 4. An optical switch which the boot would cover in the fitted position, could also be used as a switch device 4.

Figure 10:
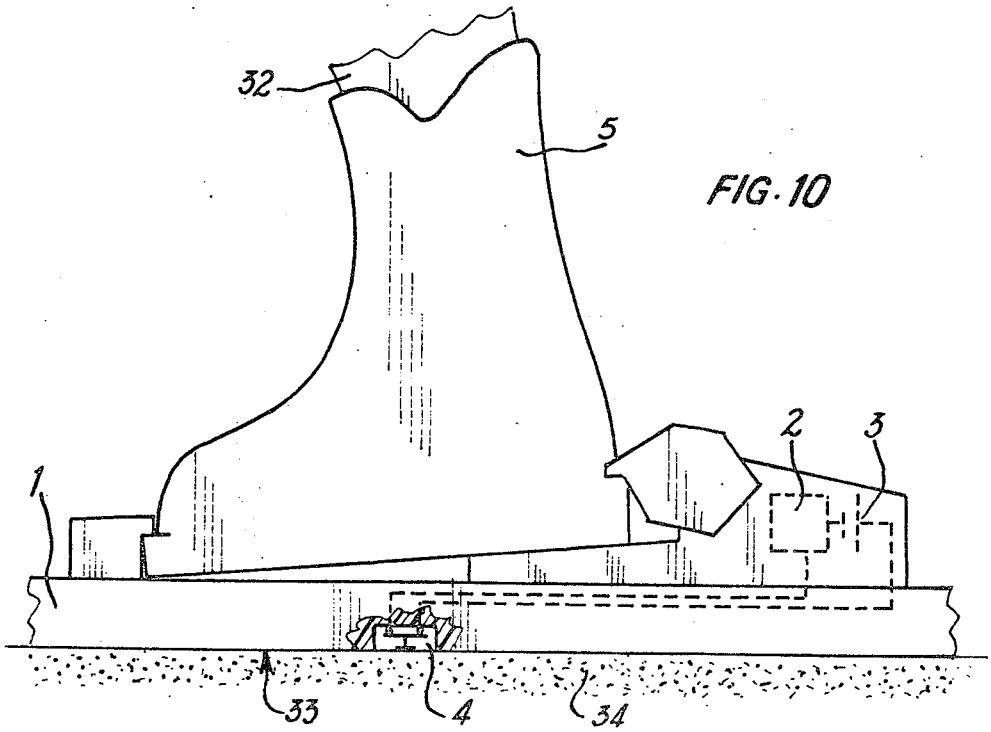

In the embodiment of FIG. 10, the switch device 4 is placed under the ski 1, preferably vertically in the region of the boot. It is thus the weight of the skier 32 which causes contact of the lower side 33 of the ski 1 with the snow 34, the switch device 4 thus closing the circuit. In this case, the circuit 2 should be completed by a delay circuit in order that the circuit 2 remains supplied with current for a certain time after the release of the device 4.

All the figures apart from FIGS. 2 and 3 show a heel with electronic release, but it is quite clear that the means according to the invention may also be used on any safety binding, such as a front abutment, multidirectional binding, plate/binding, boot/binding etc.

The detection of the presence of the boot is advantageously located in the region of the toes, at the front, or even on the side, etc.

All the embodiments show a single switch device, but it is also possible to use several devices, arranged in series.

It should be noted that certain constructions make it possible to render the skis useless (under good conditions as regards safety) to any person who does not own the corresponding boot; this is in order to reduce the risks of theft. In the embodiment of FIG. 8, where correspondence of the contacts 21 with 23 and 22 with 26 is necessary, the risk of use by third parties is greatly reduced.

Figure 11:
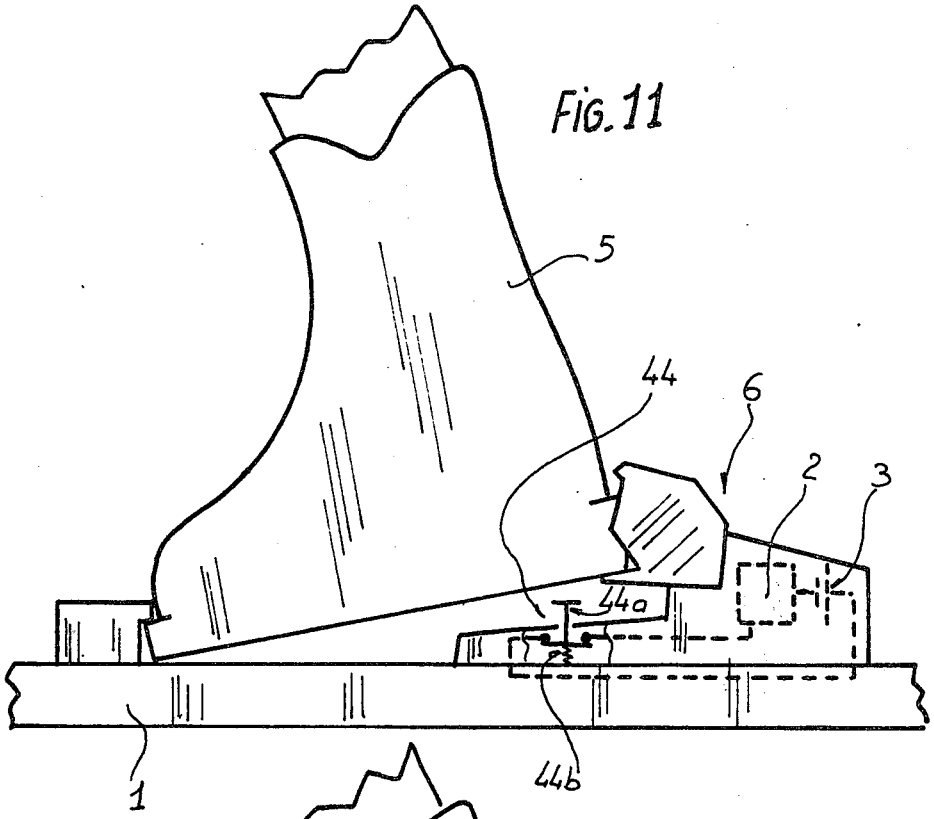
FIG. 11 is a diagrammatic elevational view of an embodiment in which the boot controls a switch device of the type which is normally closed and which is opened for skiing.
Figure 13:
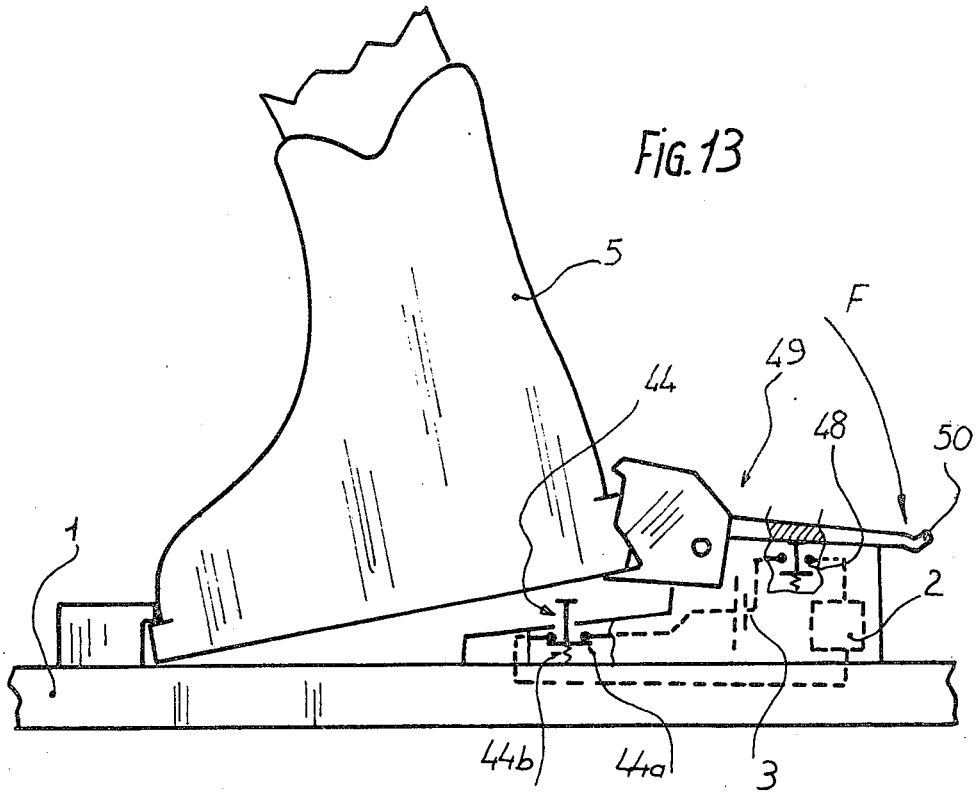
FIG. 13 is a diagrammatic elevational view of a variation in which the ski comprises two switch devices of the normally closed type, one being actuated by the boot and the other by a part of the binding controlleed manually.
Figure 14:
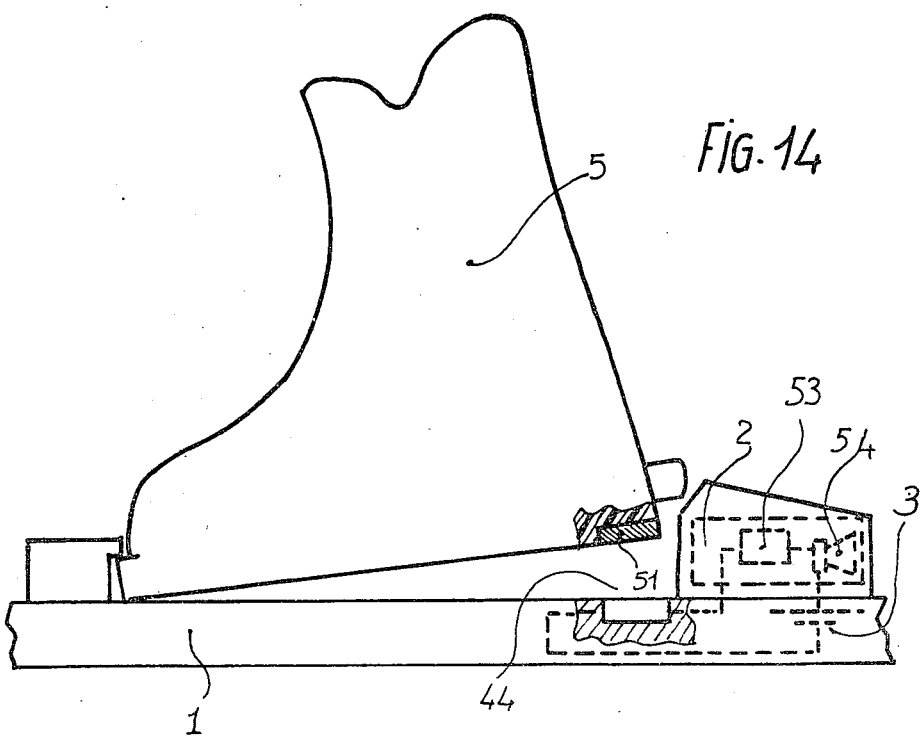
FIG. 14 is a diagrammatic elevational view of a variation in which the switch device comprises a magnetic switch.

In all the variations illustrated in FIGS. 11, 13 and 14, the electrical or electronic device 2 and the electrical supply 3 are connected in circuit with a switch device 44 which, in the inoperative state, i.e. when the ski is not fitted, is normally closed and there is thus a supply of current to the circuit 2. This switch device 44 may be constituted by a simple switch contact actuated mechanically, as shown in FIGS. 11 and 13, or magnetically as in FIG. 14, or even optically. In FIGS. 11 and 13, the switch device is shown as being constituted by a movable contact 44*a*, this contact being biased into the closed position by a return spring 44*b*.

In the embodiment illustrated in FIG. 11, the connection of the device 2 to the source of current is achieved automatically either at the time of voluntary removal of the ski, or at the time of removal as a safety measure. To this end, the switch device 44 is placed on a safety binding 6 or a part of the latter, in a region located under the sole of the boot 5. In the closed position, which is that illustrated in FIG. 11, the contact 44*a* is closed and the device 2 is supplied electrically. When the skier puts on his ski, he pushes back the contact 44*a* with the sole of his boot, thus opening the circuit supplying the device 2, which is thus disconnected. If the boot 5 is separated from the ski, by voluntary removal or removal subsequent to the release of the safety binding 6, the contact 44*a* is released and it ensures the closure of the circuit supplying the device 2.

It is thus possible to replace the switch device which is normally open of the embodiments illustrated in FIGS. 2, 3, 4, 5, 6, 7, 9, 10 by a switch device which is normally closed.

Figure 12:
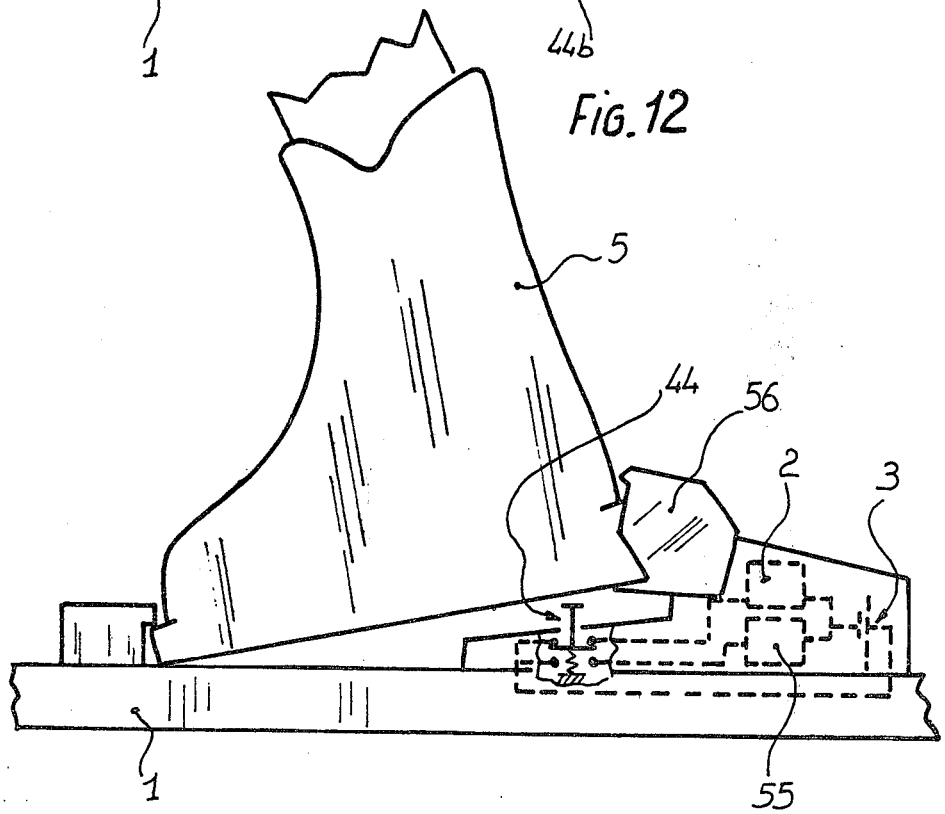
FIG. 12 is a diagrammatic elevational view of another embodiment in which the boot actuates both a normally open and a normally closed switch device.

In the variation illustrated in FIG. 12, the device 44 is a monostable bipolar push-button, that is to say that one of the contacts is normally closed and the other is normally open. At the time of fitting the ski, the closed contact opens and the open contact closes. The contact which is normally open is connected in series with a circuit 55 electrically controlling the release of a binding 56 and the contact which is normally closed is connected in series with the circuit 2, which is an electrical anti-theft device or transmitter, as seen previously.

In the variation illustrated in FIG. 13, the device 2 is supplied with current solely at the time of a safety release of the boot 5, which is not the case of the embodiment shown in FIG. 11. For this, the electrical circuit supplying the device 2 comprises a second normally closed switch device 48 which comprises a contact which is opened at the time of voluntary removal of the ski. To this end, the contact of the second switch device 48 is located in order to be actuated by an operating member of the binding 49, during voluntary removal of the ski. In the case illustrated as a non-limiting example in FIG. 13, the switch device 48 is preferably located at the upper part of the body of the binding 49, in order that the push-button for actuating its contact projects above the upper surface of the binding and may thus be actuated by a removal lever 50, when the latter is lowered substantially into a horizontal position rearwards, as shown by the arrow F. The second switch device 48 is connected in series with the remainder of the electrical circuit, in particular the switch device 44, which is normally closed. Due to this, when the binding 49 is engaged, the second switch device 48 is closed whereas the first device 44 is open, such that it is only during removal of the ski as a safety measure, i.e. at the time of closure of the first device 44, that the device 2 is supplied with current.

In the variation illustrated in FIG. 14, the switch device 44 is constituted by a magnetic switch which may be actuated by a magnet 51 supported by the sole of the boot 5; the magnetic switch constituting the switch device 44 is normally closed when the boot 5 and the plate 52 are not mounted on the ski. On the other hand, when the plate 52 is immobilized on the ski, the magnet 51 causes opening of the magnetic switch 44 thus disconnecting the electrical or electronic device 2 from the source of current. The particular embodiment of FIG. 14 shows diagrammatically that the electrical or electronic device 2 comprises a transmitter 54 producing a sound signal or a signal of some other type and a delay member 53.

What is claimed is:

1. Sports equipment which can be fitted on the feet, comprising at least one device for retaining a boot or shoe on said equipment, an electrical supply source, at least one electrical or electronic device connected to said electrical supply source, and switch means located between the electrical or electronic device and the supply source for selectively connecting the same together electrically, said switch means including a movable part controlling electrical connection between the supply source and the electrical or electronic device, and means mounting the movable part for being actuated by the foot at the time of fitting of the boot in the retaining device and at the time of any removal of the boot from the retaining device.

2. Equipment according to claim 1, in which the retaining device comprises a safety binding and the electrical or electronic device comprises a circuit controlling the release of the safety binding, said switch means automatically supplying the circuit for controlling the release, at the time of fitting of the equipment, the switch means normally being open and being mounted by said mounting means at a point where the boot presses, so that it can be actuated by this boot.

3. Equipment according to claim 2 in which the switch means is constituted by a mechanically actuated contact.

4. Equipment according to claim 2, in which the switch means comprises two fixed contact studs connected to the circuit for controlling the release and to the electrical supply source, the movable part comprising two movable contact studs co-operating respectively with the fixed contact studs, the two movable contact studs being mounted under the sole of the boot and a lead interconnecting said movable contact studs.

5. Equipment according to claim 4, in which the supply source is housed in the boot in the lead.

6. Equipment according to claim 2, in which the switch means is constituted by a proximity detector, actuated by a magnet or ferro-magnetic plate carried by the boot.

7. Equipment according to claim 2, in which the equipment is a ski and the switch means is housed in the boot or binding in order to be actuated by the skier's foot.

8. Equipment according to claim 2, in which the equipment is a ski and the switch means is actuated by a feeler actuated by the boot at the time of fitting of the ski.

9. Equipment according to claim 2, in which the switch means is actuated by the safety binding subsequent to its movement at the time of fitting the equipment.

10. Equipment according to claim 2, in which the equipment is a ski and the switch means is actuated by at least one movable part of the safety binding subsequent to its movement at the time of fitting the ski.

11. Equipment according to claim 2, in which the equipment is a ski and the switch means is housed under the ski in order to be actuated by the weight of the skier and the circuit further includes a delay circuit.

12. Equipment according to claim 1, in which the switch means automatically connects the electrical or electronic device to the source of current at the time of separation of the boot and said equipment and disconnects the device from the source of current at the time of positioning of the boot on said equipment.

13. Equipment according to claim 12, in which the switch means is constituted partly by the equipment and partly by the boot.

14. Equipment according to claim 12, further comprising a release plate on which the boot is mounted positioned for actuating the movable part of the switch means when the boot is released.

15. Equipment according to claim 14, in which the switch means comprises a switch which is normally closed and is opened by the boot at the time of positioning the boot in the equipment.

16. Equipment according to claim 15, in which the switch means is of the mechanical type and comprises a movable contact, a spring biassing said contact and an actuating pushbutton integral with said contact and moved upon release of the boot.

17. Equipment according to claim 15, in which the switch means is of the magnetic type and is actuated by a magnet associated with the boot.

18. Equipment according to claim 15, in which the equipment is a ski further comprising a second switch means connected in circuit with the first switch means, the electrical or electronic device and the electrical supply source, said second switch means being actuated by a member of the retaining means which can be operated manually for voluntary removal of the ski in order to connect the device to the source of current in the case of a release of the boot as a safety measure.

19. Equipment according to claim 14, in which the switch means is housed in the retaining device and the electrical or electronic device and the electrical supply source are housed in the retaining device.

20. Equipment according to claim 12, further comprising means for controlling electrical release of the retaining device, the switch means being connected to said means controlling electrical release of the retaining device such that when the boot is mounted on the equipment, said means for controlling electrical release of the retaining device is connected to the electrical supply source whereas the electrical or electronic device is disconnected 21. Equipment according to claim 12 wherein the device for retaining the boot comprises a movable member positioned for actuating the movable part of the switch means when the boot is released.

22. Equipment according to claim 1, in which the electrical or electronic device comprises a sound transmitter.

* * * * *